US009095962B2

(12) United States Patent
Hu

(10) Patent No.: US 9,095,962 B2
(45) Date of Patent: Aug. 4, 2015

(54) HEXAGONAL WRENCH

(71) Applicant: Bobby Hu, Taichung (TW)

(72) Inventor: Bobby Hu, Taichung (TW)

( * ) Notice: Subject to any disclaimer, the term of this patent is extended or adjusted under 35 U.S.C. 154(b) by 264 days.

(21) Appl. No.: 13/729,150

(22) Filed: Dec. 28, 2012

(65) Prior Publication Data

US 2014/0060266 A1 Mar. 6, 2014

(30) Foreign Application Priority Data

Aug. 29, 2012 (TW) ..... 101131347 A

(51) Int. Cl.
*B25B 23/00* (2006.01)

(52) U.S. Cl.
CPC ..... *B25B 23/0028* (2013.01); *B25B 23/0021* (2013.01)

(58) Field of Classification Search
CPC ..... B25B 23/0007; B25B 23/0021; B25B 23/0028; B25B 13/02; B25B 15/004; B25B 15/008; B25G 1/06; B25G 1/063
USPC ..... 81/450, 440, 177.7, 177.2, 124.6; D8/26, 21
See application file for complete search history.

(56) References Cited

U.S. PATENT DOCUMENTS

| | | | | |
|---|---|---|---|---|
| 1,380,643 | A * | 6/1921 | Eagle | 81/177.7 |
| 4,527,925 | A * | 7/1985 | Bauer et al. | 403/143 |
| 6,240,813 | B1 * | 6/2001 | Hyatt | 81/124.6 |
| 6,443,039 | B1 | 9/2002 | Warner | |
| 8,464,616 | B2 * | 6/2013 | Chang | 81/177.7 |
| 8,695,463 | B2 * | 4/2014 | Su | 81/177.7 |
| 2010/0154604 | A1 * | 6/2010 | Su | 81/450 |
| 2013/0139659 | A1 * | 6/2013 | Yang | 81/177.7 |

* cited by examiner

*Primary Examiner* — Hadi Shakeri
(74) *Attorney, Agent, or Firm* — Alan D. Kamrath; Kamrath IP Lawfirm, P.A.

(57) ABSTRACT

A hexagonal wrench includes a driving member and an actuating member. The driving member includes a hexagonal driving section for driving a bolt having a hexagonal socket. The driving member further includes a pivotal section pivotably connected with the actuating member, allowing relative pivotal movement between the driving member and the actuating member during operation. An area of the driving member is smaller than an area of the driving section to provide enhanced structural strength, preventing deformation and damage of the hexagonal wrench while providing reliable connection between the driving member and the actuating member.

9 Claims, 15 Drawing Sheets

HEXAGONAL WRENCH

BACKGROUND OF THE INVENTION

The present invention relates to a hexagonal wrench and, more particularly, to a hexagonal wrench including a driving member and an actuating member pivotable relative to the driving member.

U.S. Pat. No. 6,443,039 discloses a wrench having two driving stems pivotally connected with each other. One of the driving stems includes two fillets having a space therebetween. The other driving stem includes an end having a male joint pivotably received in the space between the fillets. However, the thickness and cross sectional area of the male joint are smaller than those of the other end of the other driving stem. If the other driving stem with the male joint is formed by milling, the structural strength of the other driving stem with the male joint is adversely affected and, thus, can not withstand high-torque operation, as the male joint of the other driving stem is liable to deform and damage. In particular, if the two driving stems are perpendicular to each other, the shear force imparted to the male joint of the other driving stem is larger than the shear force imparted to the other end of the other driving stem. Stress concentration is liable to occur in a connecting section between the male joint and the other end of the other driving stem having the male joint formed by milling. Thus, the wrench of this type has insufficient structural strength while having a short service life.

Thus, a need exists for a novel hexagonal wrench including a driving member with an enhanced structural strength.

BRIEF SUMMARY OF THE INVENTION

The present invention solves this need and other problems in the field of durable hexagonal wrenches by providing a hexagonal wrench including a driving member having a driving section and a pivotal section. The driving member includes a central axis extending through the driving section and the pivotal section. The driving section includes first, second, third, fourth, fifth, and sixth faces, with the first face opposite to the second face, with the third face opposite to the fourth face, with the fifth face opposite to the sixth face, with the first, second, third, fourth, fifth, and sixth faces together defining a regular hexagon. The pivotal section includes a first pivotal face and a second pivotal face opposite to the first pivotal face. The first pivotal face extends from the first face, and the second pivotal face extends from the second face. The driving section has a first length between the first and second faces and perpendicular to the central axis. The pivotal section has a second length between the first and second pivotal faces and perpendicular to the central axis. The second length is smaller than the first length. The first and second faces have the same first width perpendicular to the first length and the central axis and spaced from the central axis. The first and second pivotal faces have the same second width perpendicular to the second length and the central axis and spaced from the central axis. The second width is larger than the first width. The driving section includes a first area perpendicular to the central axis. The pivotal section includes a second area perpendicular to the central axis. The second area is larger than the first area. A connection section extends between the driving section and the pivotal section. The connection section includes a first connection face having a first end connected to the first face and a second end connected to the first pivotal face. The connection section further includes a second connection face having a first end connected to the second face and a second end connected to the second pivotal face. A thickness between the first ends of the first and second connection faces is equal to the first length. A thickness between the second ends of the first and second connection faces is equal to the second length. The connection section has decreasing thicknesses towards the pivotal section. The first end of each of the first and second connection faces has a width perpendicular to the thickness and equal to the first width. The second end of each of the first and second connection faces has a width perpendicular to the thickness and equal to the second width. Each of the first and second connection faces has increasing widths towards the pivotal section.

The hexagonal wrench further includes an actuating member having a pivotal end and an operative end opposite to the pivotal end. The pivotal end is pivotably connected to the pivotal section of the driving member, allowing pivotal movement of the driving member relative to the actuating member. The operative end is adapted to be held and operated by a user.

In the form shown, the pivotal end of the actuating member includes first and second lugs. The first lug includes a first abutment face facing the second lug. The second lug includes a second abutment face facing the first lug. A compartment is formed between the first and second abutment faces. The pivotal section of the driving member is pivotably received in the compartment of the actuating member, with the first pivotal face abutting the first abutment face of the first lug, with the second pivotal face abutting the second abutment face of the second lug.

In the form shown, the pivotal section of the driving member further includes first, second, third, and fourth surfaces, with the first surface opposite to the second surface, with the third surface opposite to the fourth surface, with the first surface extending from the third face, with the second surface extending from the fourth face, with the third surface extending from the fifth face, with the fourth surface extending from the sixth face. The driving section includes a third length between the third and fourth faces. The pivotal section includes a fourth length between the first and second surfaces. The fourth length is larger than the third length. The driving section further includes a fifth length between the fifth and sixth faces. The pivotal section further includes a sixth length between the third and fourth surfaces. The sixth length is larger than the fifth length. The first pivotal face, the second pivotal face, the first surface, the second surface, the third surface, and the fourth surface together define the second area.

In the form shown, the connection section further includes third, fourth, fifth, and sixth connection faces, with the first connection face opposite to the second connection face, with the third connection face opposite to the fourth connection face, with the fifth connection face opposite to the sixth connection face. The third connection face includes a first end connected to the third face and a second end connected to the first surface. The fourth connection face includes a first end connected to the fourth face and a second end connected to the second surface. The fifth connection face includes a first end connected to the fifth face and a second end connected to the third surface. The sixth connection face includes a first end connected to the sixth face and a second end connected to the fourth surface. A spacing between the first ends of the third and fourth connection faces is equal to the third length. A spacing between the second ends of the third and fourth connection faces is equal to the fourth length. The third and fourth connection faces have increasing spacings towards the pivotal section. A spacing between the first ends of the fifth and sixth connection faces is equal to the fifth length. A spacing between the second ends of the fifth and sixth connection faces is equal to the sixth length. The fifth and sixth connection faces have increasing spacings towards the pivotal section.

In the form shown, the central axis extends through the connection section. An end of the connection section connected to the driving section has a cross sectional area perpendicular to the central axis, with the cross sectional area of the end of the connection section equal to the first area. The other end of the connection section connected to the pivotal section has a cross sectional area perpendicular to the central axis, with the cross sectional area of the other end of the connection section equal to the second area. The connection section has increasing cross sectional areas towards the pivotal section.

An operative rod can be coupled to the operative end of the actuating member and operable to drive the hexagonal wrench. In the form shown, the operative end of the actuating member includes a receptacle having an inner periphery with a toothed portion. An end of the operative rod has hexagonal cross sections and is detachably engaged with the toothed portion, preventing the operative rod from rotating relative to the actuating member.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
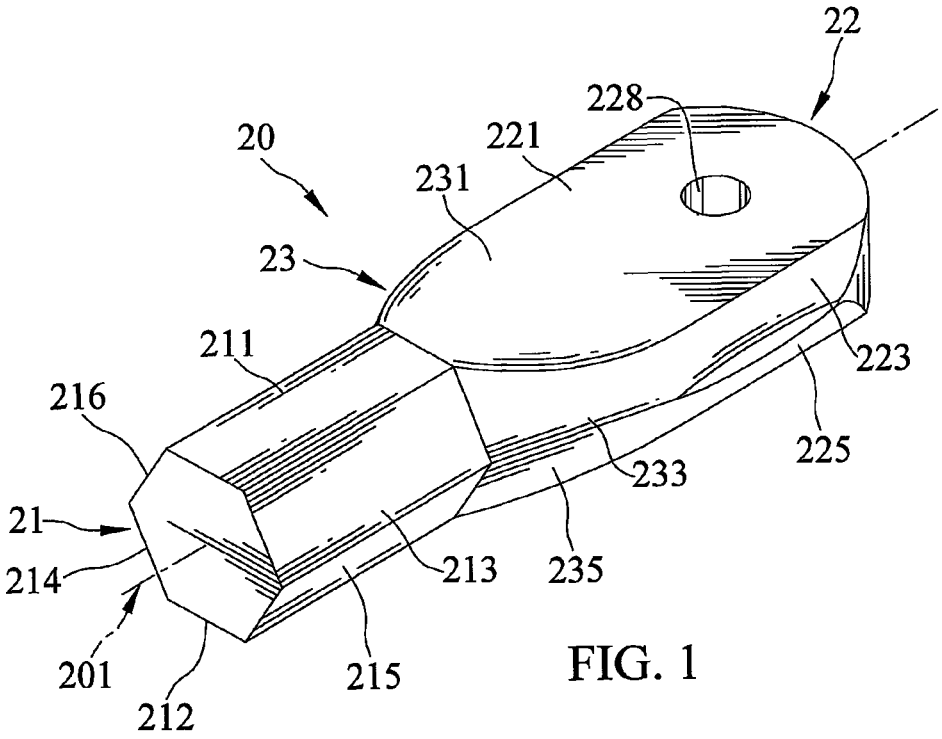
FIG. 1 shows a perspective view of a driving member of a hexagonal wrench according to the present invention.
Figure 2:
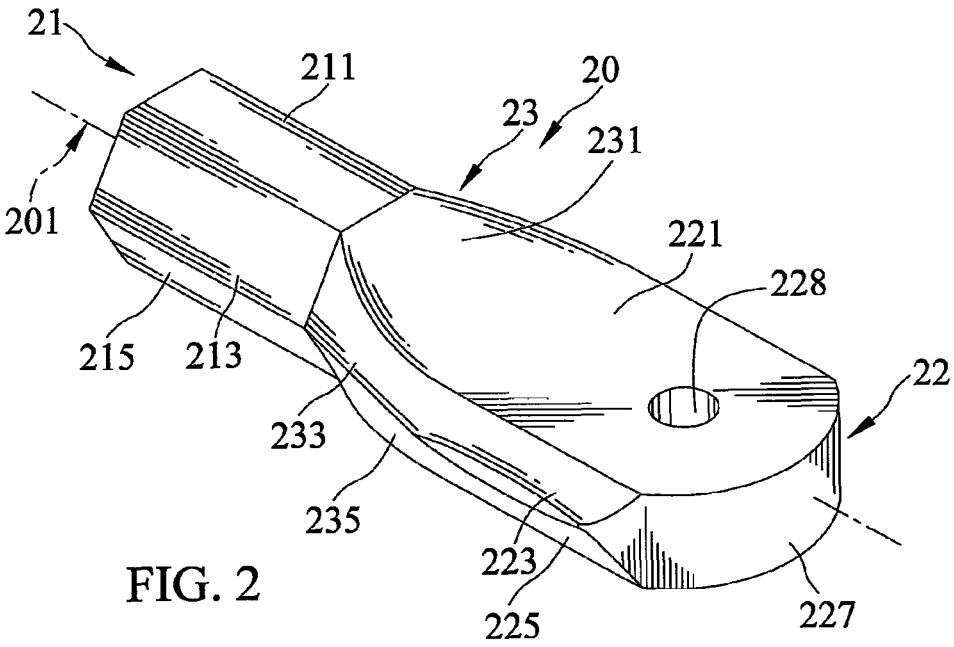
FIG. 2 shows another perspective view of the driving member of FIG. 1.
Figure 3:
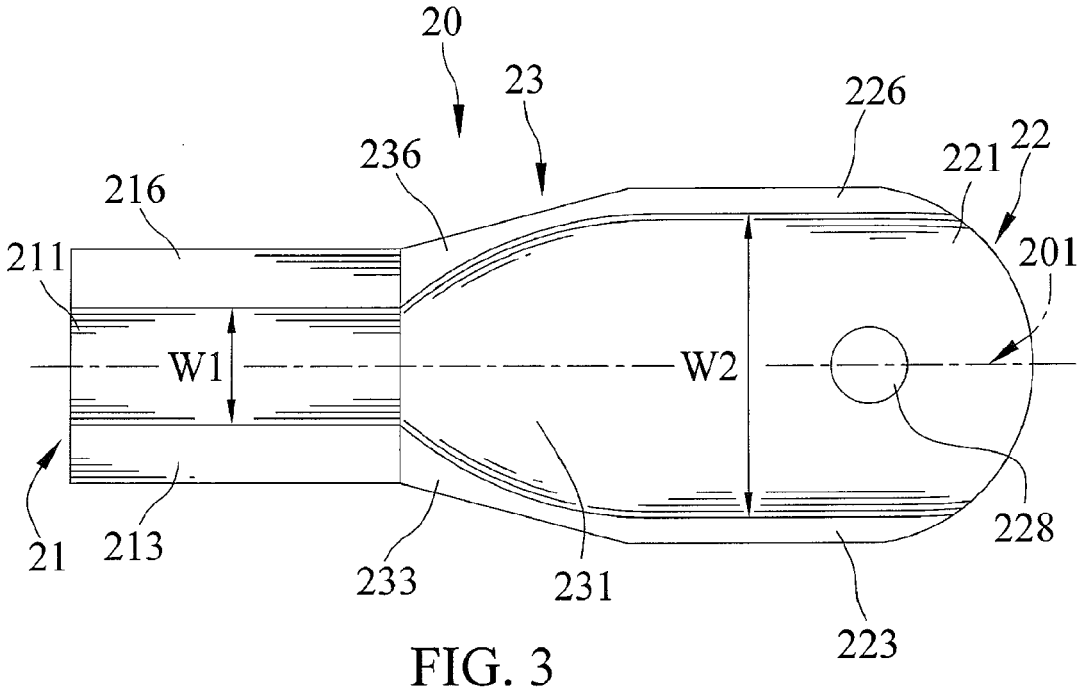
FIG. 3 shows a top view of the driving member of FIG. 1.
Figure 4:
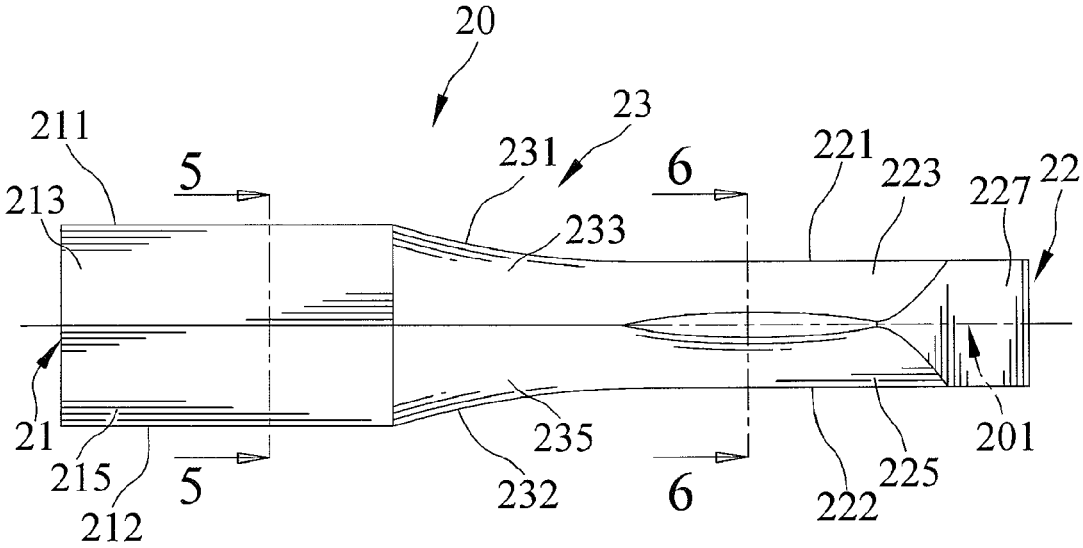
FIG. 4 shows a front elevational view of the driving member of FIG. 1.
Figure 5:
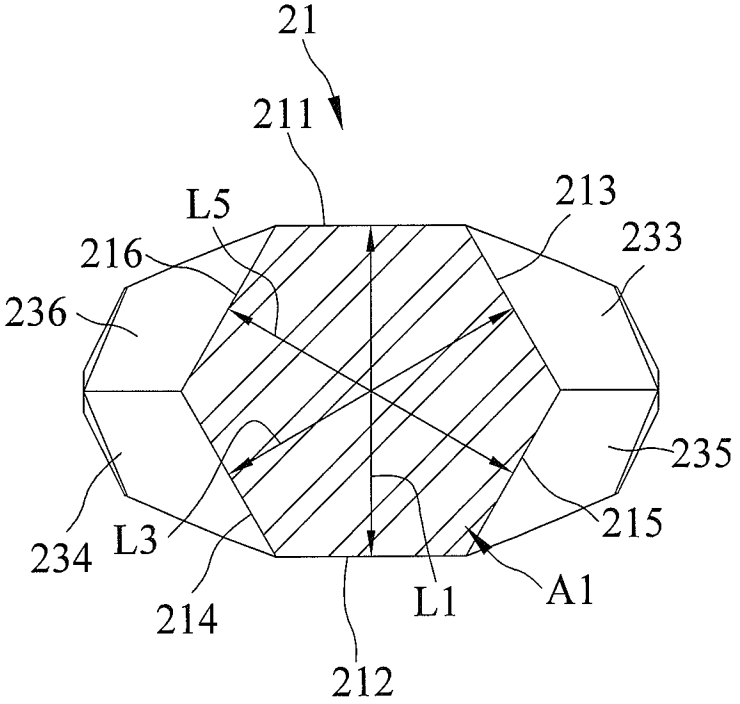
FIG. 5 shows a cross sectional view taken along section line 5-5 of FIG. 4.
Figure 6:
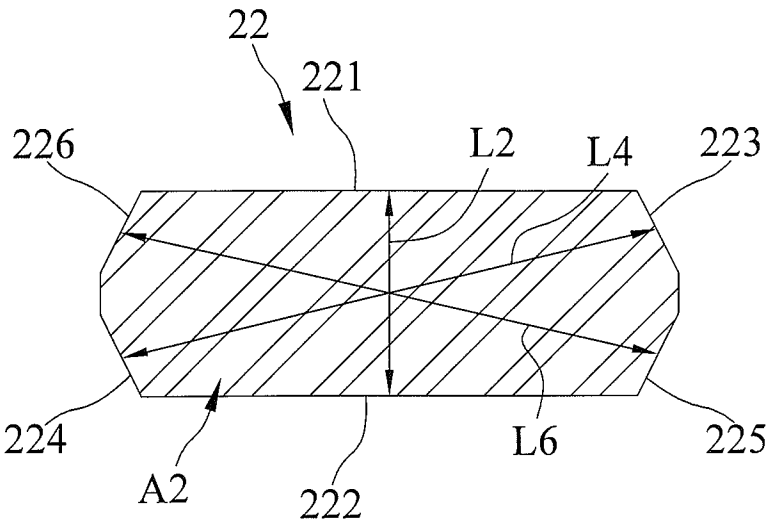
FIG. 6 shows a cross sectional view taken along section line 6-6 of FIG. 4.
Figure 7:
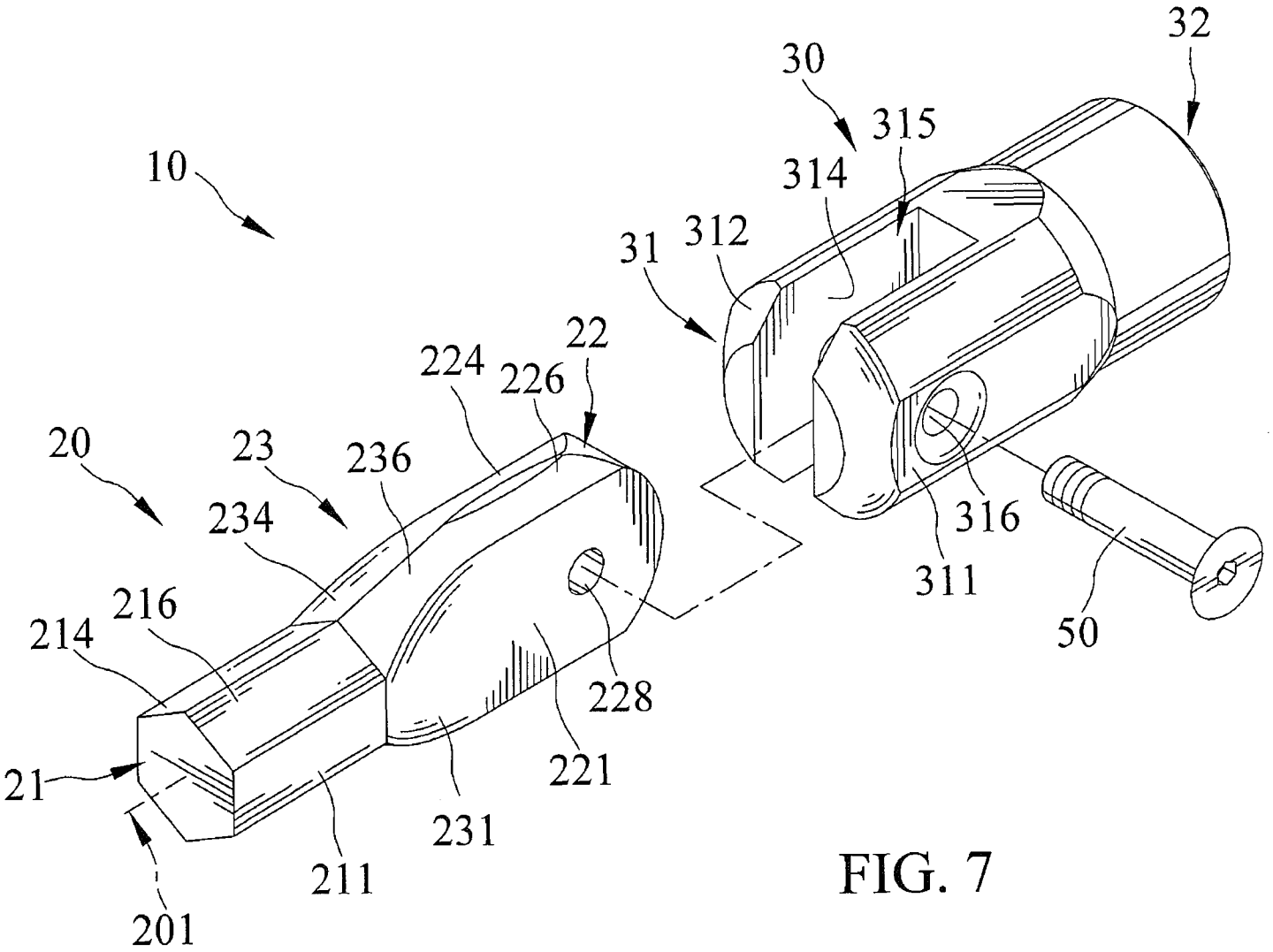
FIG. 7 shows an exploded, perspective view of the hexagonal wrench according to the present invention.
Figure 8:
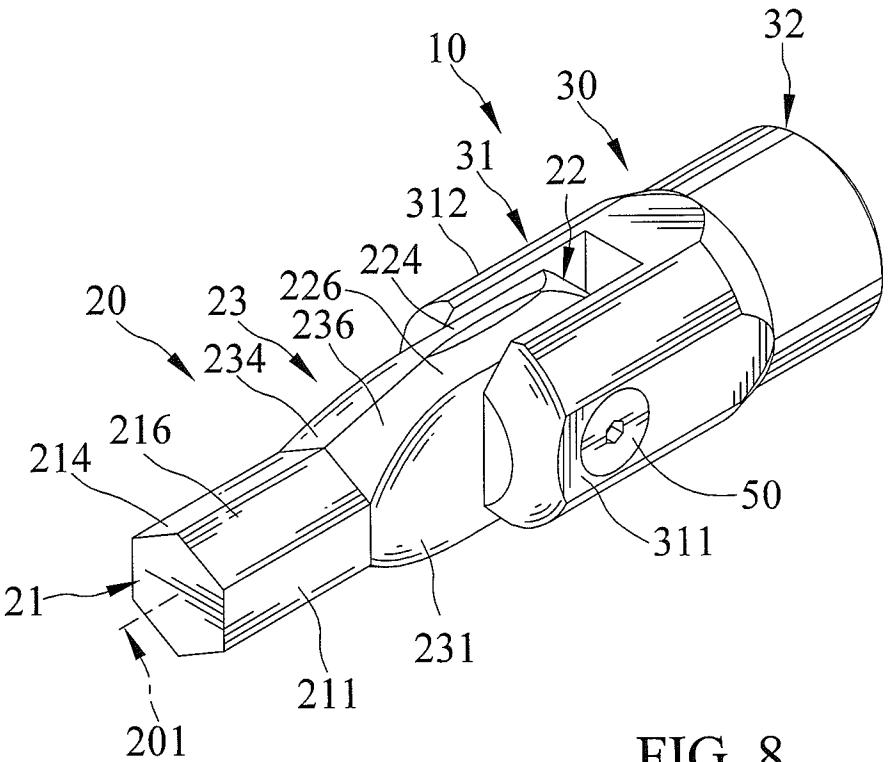
FIG. 8 shows a perspective view of the hexagonal wrench of FIG. 7.
Figure 9:
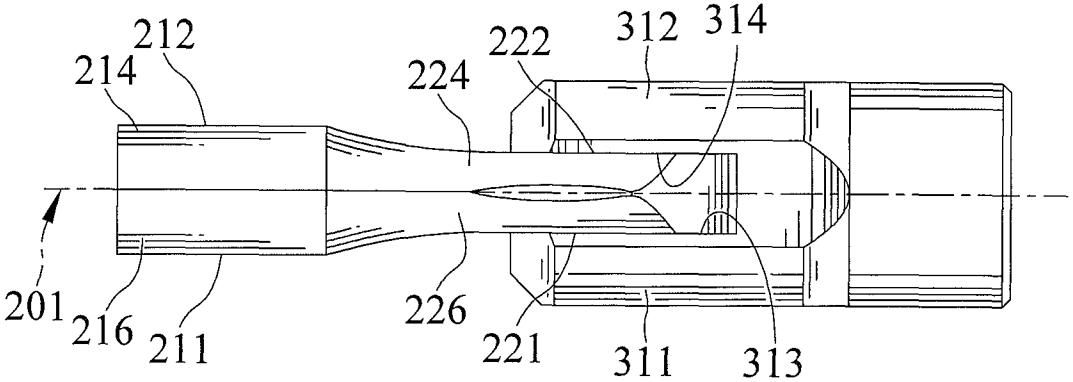
FIG. 9 shows a top view of the hexagonal wrench of FIG. 8.
Figure 10:
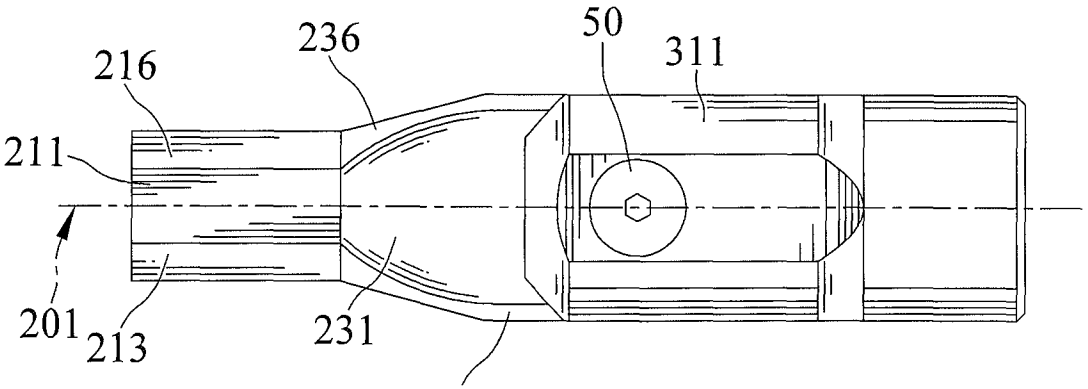
FIG. 10 shows a front elevational view of the hexagonal wrench of FIG. 8.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "third", "fourth", "fifth", "sixth", "lower", "upper", "top", "bottom", "side", "end", "portion", "section", "spacing", "length", "width", "thickness", and similar terms are used herein, it should be understood that these terms have reference only to the structure shown in the drawings as it would appear to a person viewing the drawings and are utilized only to facilitate describing the illustrative embodiments.

DETAILED DESCRIPTION OF THE INVENTION

With reference to FIGS. 1-10, a hexagonal wrench 10 according to the present invention includes a driving member 20 and an actuation member 30. The driving member 20 includes a driving section 21 and a pivotal section 22. The driving member 20 includes a central axis 201 extending through the driving section 21 and the pivotal section 22. The driving section 21 includes first, second, third, fourth, fifth, and sixth faces 211, 212, 213, 214, 215, and 216, with the first face 211 opposite to the second face 212, with the third face 213 opposite to the fourth face 214, with the fifth face 215 opposite to the sixth face 216, with the first, second, third, fourth, fifth, and sixth faces 211, 212, 213, 214, 215, and 216 together defining a regular hexagon. The driving section 21 can be used to engage with a hexagonal socket in a bolt or a nut.

The pivotal section 22 includes a first pivotal face 221, a second pivotal face 222, a first surface 223, a second surface 224, a third surface 225, and a fourth surface 226, with the first pivotal face 221 parallel and opposite to the second pivotal face 222, with the first surface 223 opposite to the second surface 224, with the third surface 225 opposite to the fourth surface 226, with the first and second pivotal faces 221 and 222 and the first to fourth surfaces 223, 224, 225, and 226 together defining a flat column having six faces.

The first pivotal face 221 extends from the first face 211. The second pivotal face 222 extends from the second face 212. The first surface 223 extends from the third face 213. The second surface 224 extends from the fourth face 214. The third surface 225 extends from the fifth face 215. The fourth surface 226 extends from the sixth face 216. The driving section 21 has a first length L1 between the first and second faces 211 and 212 and perpendicular to the central axis 201. The pivotal section 22 has a second length L2 between the first and second pivotal faces 221 and 222 and perpendicular to the central axis 201. The second length L2 is smaller than the first length L1. The first and second faces 211 and 212 have the same first width W1 perpendicular to the first length L1 and the central axis 201 and spaced from the central axis 201. The first and second pivotal faces 221 and 222 have the same a second width W2 perpendicular to the second length L2 and the central axis 201 and spaced from the central axis 201. The second width W2 is larger than the first width W1.

The driving section 21 includes a third length L3 between the third and fourth faces 213 and 214 and perpendicular to the central axis 201. The pivotal section 22 includes a fourth length L4 between the first and second surfaces 223 and 224 and perpendicular to the central axis 201. The fourth length L4 is larger than the third length L3. The driving section 21 further includes a fifth length L5 between the fifth and sixth faces 215 and 216 and perpendicular to the central axis 201. The pivotal section 22 further includes a sixth length L6 between the third and fourth surfaces 225 and 226 and perpendicular to the central axis 201. The sixth length L6 is larger than the fifth length L5. The first length L1 is equal to the third length L3 and equal to the fifth length L5.

The driving section 21 includes a first area A1 perpendicular to the central axis 201. The pivotal section 22 includes a second area A2 perpendicular to the central axis 201. The second area A2 defined by the first pivotal face 221, the second pivotal face 222, the first surface 223, the second surface 224, the third surface 225, and the fourth surface 226 is larger than the first area A1 defined by the first to sixth faces 211, 212, 213, 214, 215, and 216. The pivotal section 22 of the driving member 20 further includes an end face 227, with the end face 227 being arcuate and convex. The pivotal section 22 further includes a pivotal hole 228 extending from the first pivotal face 221 through the second pivotal face 222.

The driving member 20 further includes a connection section 23 extending between the driving section 21 and the pivotal section 22. The connection section 23 includes first, second, third, fourth, fifth, and sixth connection faces 231, 232, 233, 234, 235, and 236, with the first connection face 231 opposite to the second connection face 232, with the third connection face 233 opposite to the fourth connection face 234, with the fifth connection face 235 opposite to the sixth connection face 236. Each of the first and second connection faces 231 and 232 is a concave face.

The first connection face 231 has a first end connected to the first face 211 and a second end connected to the first pivotal face 221. The second connection face 232 has a first end connected to the second face 212 and a second end connected to the second pivotal face 222. The third connection face 233 has a first end connected to the third face 213 and a second end connected to the first surface 223. The fourth connection face 234 has a first end connected to the fourth face 214 and a second end connected to the second surface 224. The fifth connection face 235 has a first end connected to the fifth face 215 and a second end connected to the third surface 225. The sixth connection face 236 has a first end connected to the sixth face 216 and a second end connected to the fourth surface 226.

A thickness between the first ends of the first and second connection faces 231 and 232 is equal to the first length L1. A thickness between the second ends of the first and second connection faces 231 and 232 is equal to the second length L2. The connection section 23 has decreasing thicknesses towards the pivotal section 22. The first end of each of the first and second connection faces 231 and 232 has a width perpendicular to the thickness and equal to the first width W1. The second end of each of the first and second connection faces 231 and 232 has a width perpendicular to the thickness and equal to the second width W2. Each of the first and second connection faces 231 and 232 has increasing widths towards the pivotal section 22.

A spacing between the first ends of the third and fourth connection faces 233 and 234 is equal to the third length L3. A spacing between the second ends of the third and fourth connection faces 233 and 234 is equal to the fourth length L4. The third and fourth connection faces 233 and 234 have increasing spacings towards the pivotal section 22. A spacing between the first ends of the fifth and sixth connection faces 235 and 236 is equal to the fifth length L5. A spacing between the second ends of the fifth and sixth connection faces 235 and 236 is equal to the sixth length L6. The fifth and sixth connection faces 235 and 236 have increasing spacings towards the pivotal section 22.

The central axis 201 extends through the connection section 23. An end of the connection section 23 connected to the driving section 21 has a cross sectional area perpendicular to the central axis 201, with the cross sectional area of the end of the connection section 23 equal to the first area A1. The other end of the connection section 23 connected to the pivotal section 22 has a cross sectional area perpendicular to the central axis 201, with the cross sectional area of the other end of the connection section 23 equal to the second area A2. The connection section 23 has increasing cross sectional areas towards the pivotal section 22.

The actuating member 30 includes a pivotal end 31 pivotably connected to the pivotal section 22 of the driving member 20, allowing pivotal movement of the driving member 20 relative to the actuating member 30. The pivotal end 31 of the actuating member 30 includes first and second lugs 311 and 312, with the first lug 311 including a first abutment face 313 facing the second lug 312, with the second lug 312 including a second abutment face 314 facing the first lug 311, with a compartment 315 formed between the first and second abutment faces 313 and 314. The pivotal end 31 of the actuating member 30 includes a pivotal hole 316 extending through the first and second lugs 311 and 312.

The pivotal section 22 of the driving member 20 is pivotably received in the compartment 315 of the actuating member 30, with the first pivotal face 221 abutting the first abutment face 313 of the first lug 311, with the second pivotal face 222 abutting the second abutment face 314 of the second lug 312, with the pivotal hole 228 of the driving member 20 aligned with the pivotal hole 316 of the actuating member 30. A pin 50 extends through the pivotal holes 228 and 316 of the driving member 20 and the actuating member 30. The arcuate, convex end face 227 does not contact with the actuating member 30 when the driving member 20 pivots relative to the actuating member 30.

Figure 11:
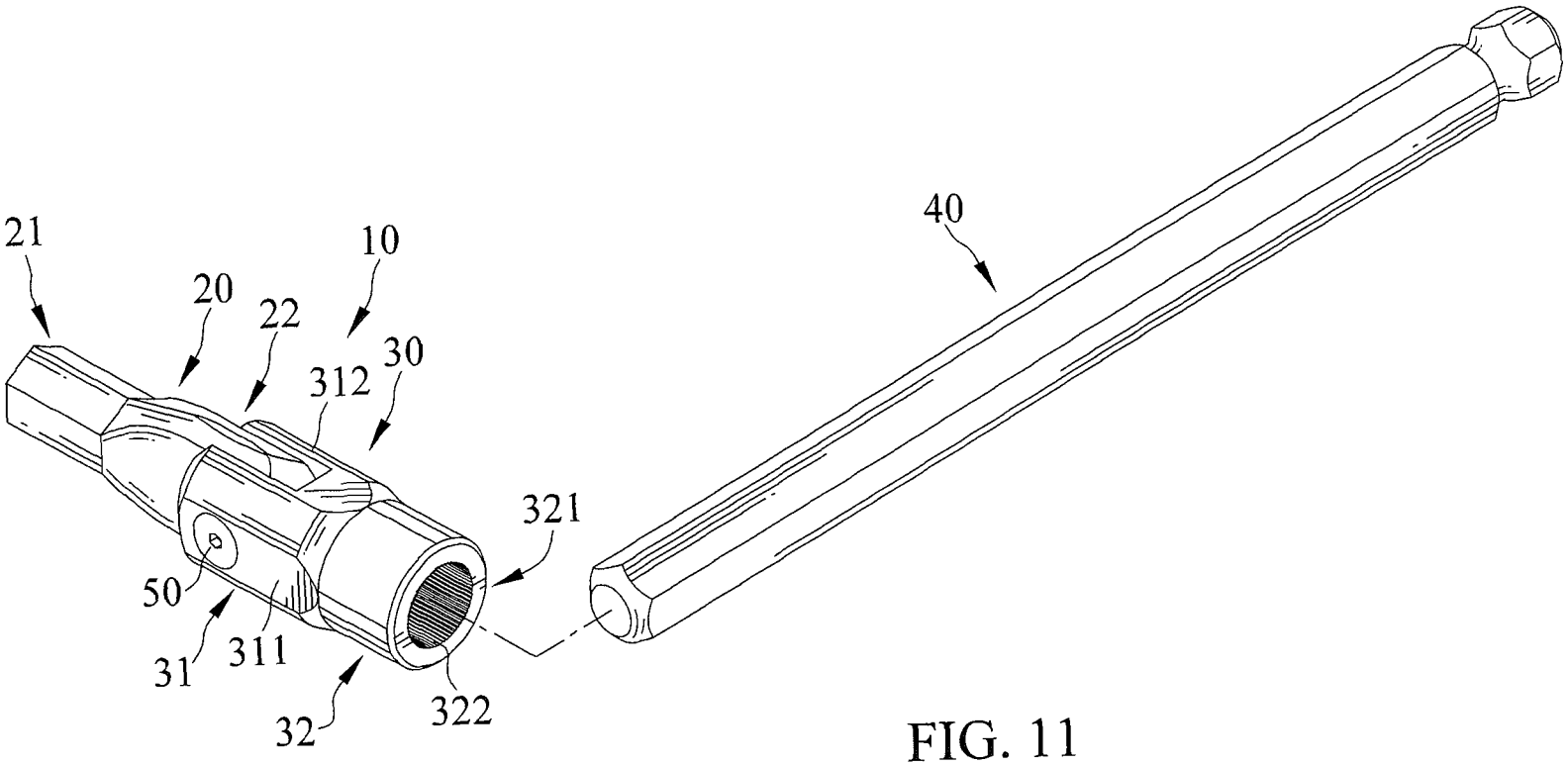
FIG. 11 shows a perspective view illustrating engagement of the hexagonal wrench with an operative rod.

With reference to FIG. 11, the actuating member 30 further includes an operative end 32 opposite to the pivotal end 31. The operative end 32 is adapted to be held and operated by a user. In the form shown, the operative end 32 of the actuating member 30 includes a receptacle 321 having circular cross sections. The receptacle 321 includes an inner periphery having a toothed portion 322.

An operative rod 40 can be detachably coupled to the operative end 32 of the actuating member 30 and operable to drive the actuating member 30. The operative rod 40 includes an end having hexagonal cross sections and detachably engaged with the toothed portion 322, preventing the operative rod 40 from rotating relative to the actuating member 30.

Figure 12:
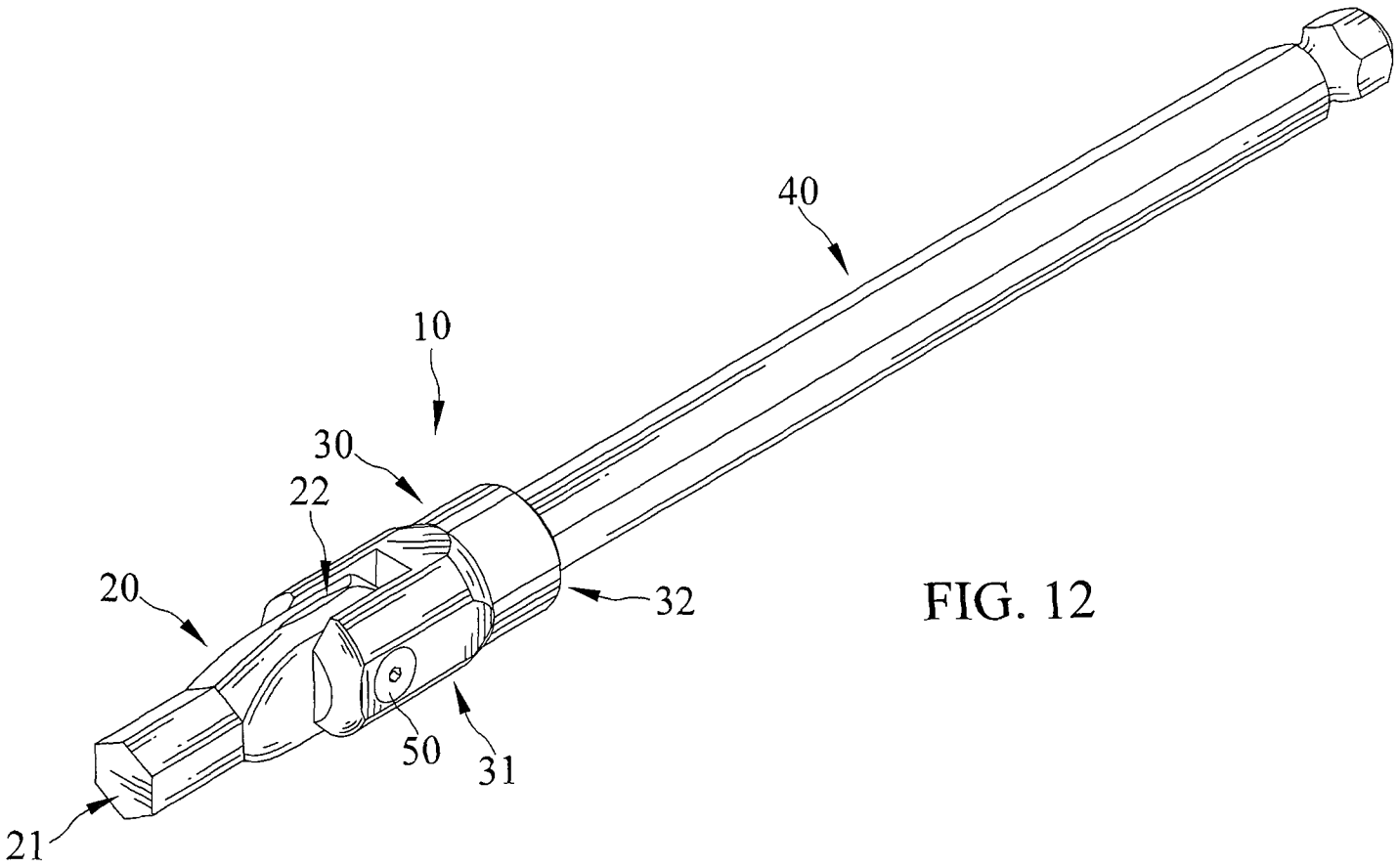
FIG. 12 shows a perspective view of the hexagonal wrench and the operative rod after assembly, with the operative rod coaxial to the hexagonal wrench.
Figure 13:
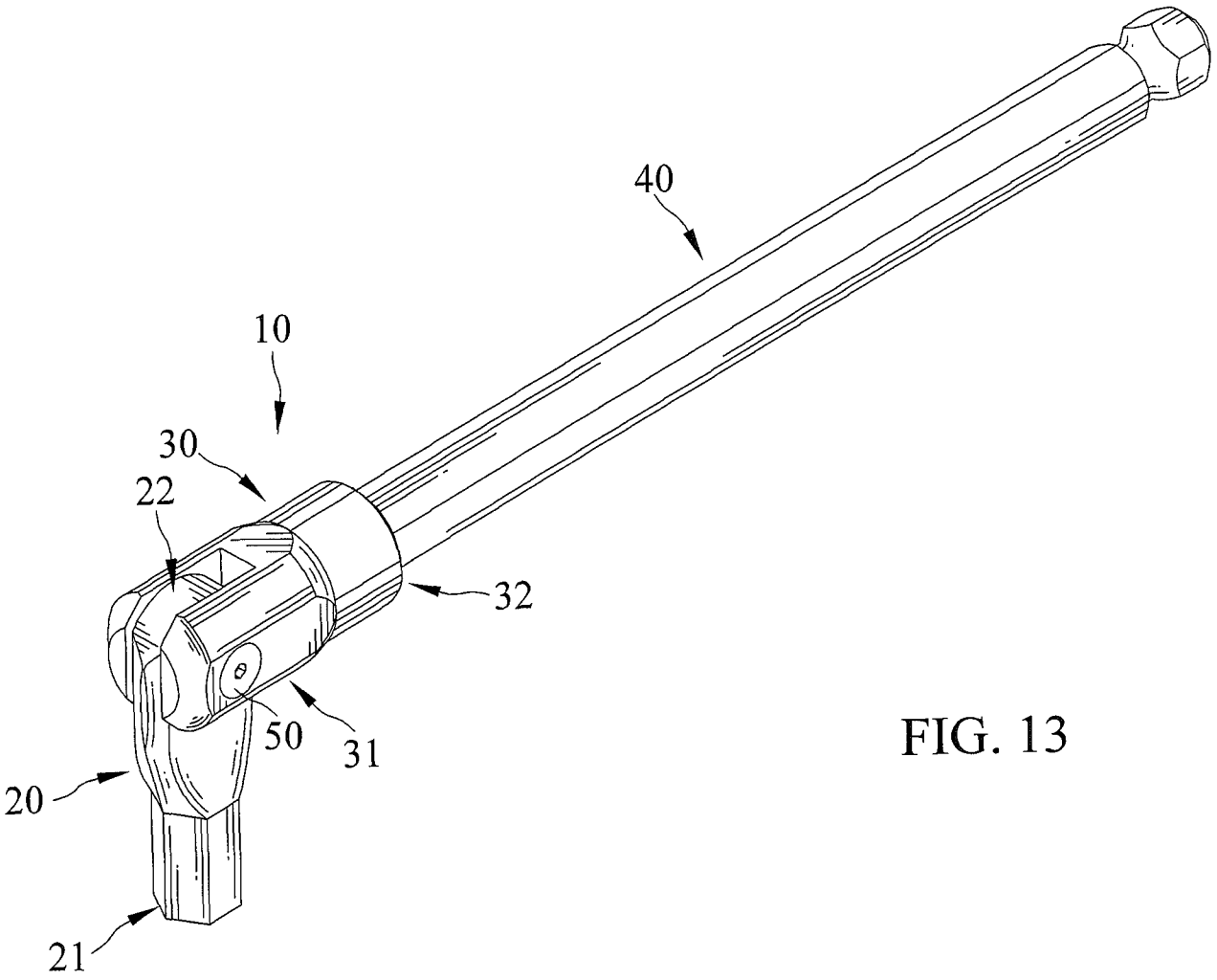
FIG. 13 shows another perspective view of the hexagonal wrench and the operative rod, with the operative rod perpendicular to the hexagonal wrench.
Figure 14:
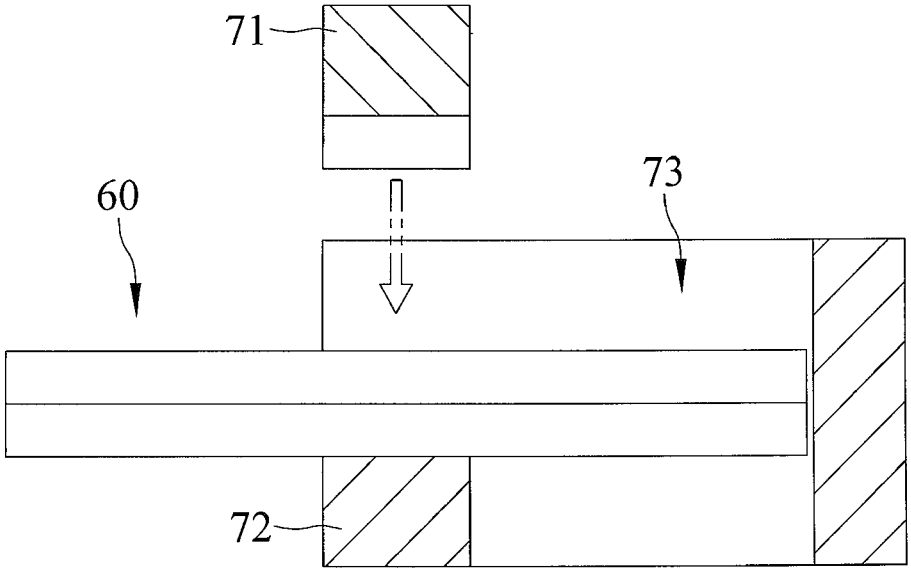
FIG. 14 shows a front view illustrating a first step of a first procedure for producing the driving member.
Figure 15:
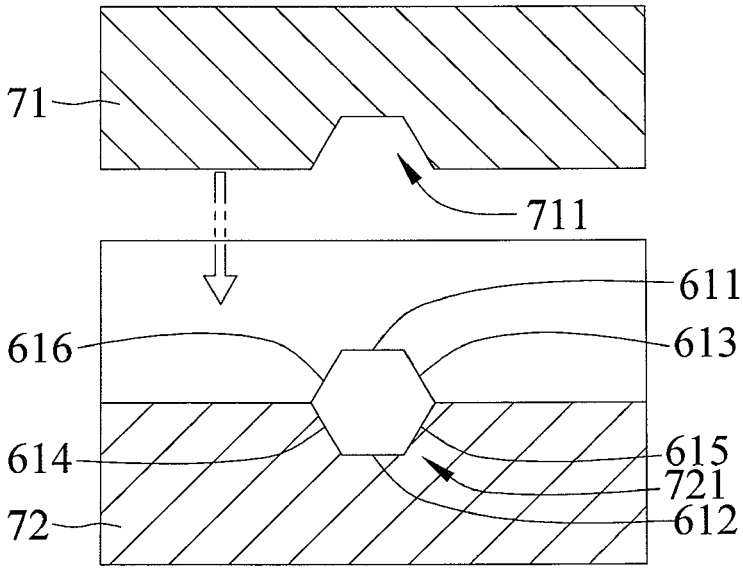
FIG. 15 shows a side view illustrating the first step of a first processing procedure.
Figure 16:
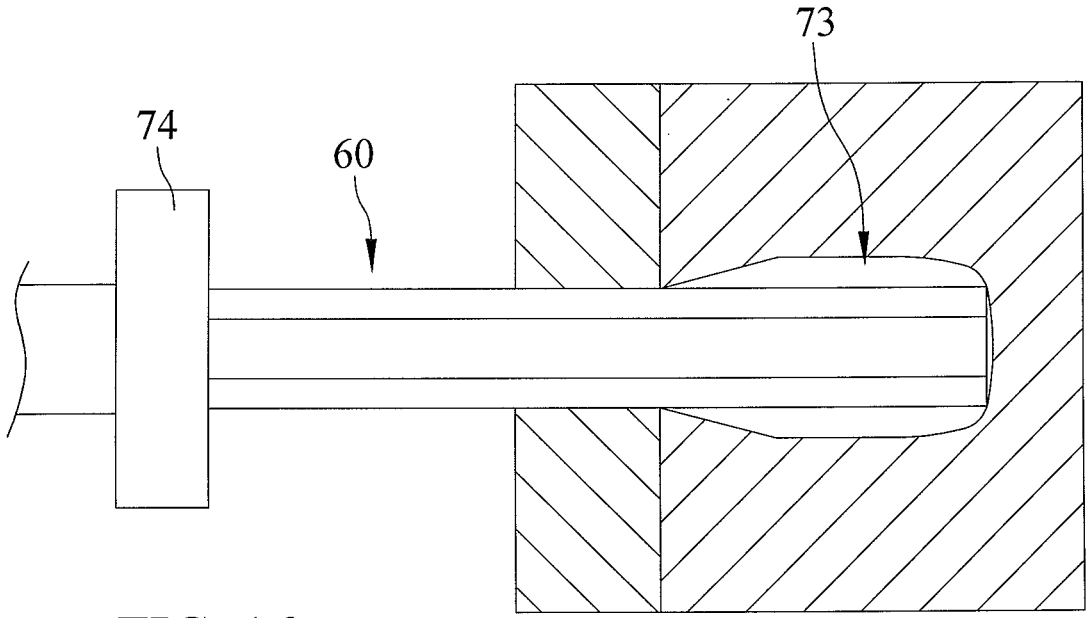
FIG. 16 shows a top view illustrating a second step of the first processing procedure.
Figure 17:
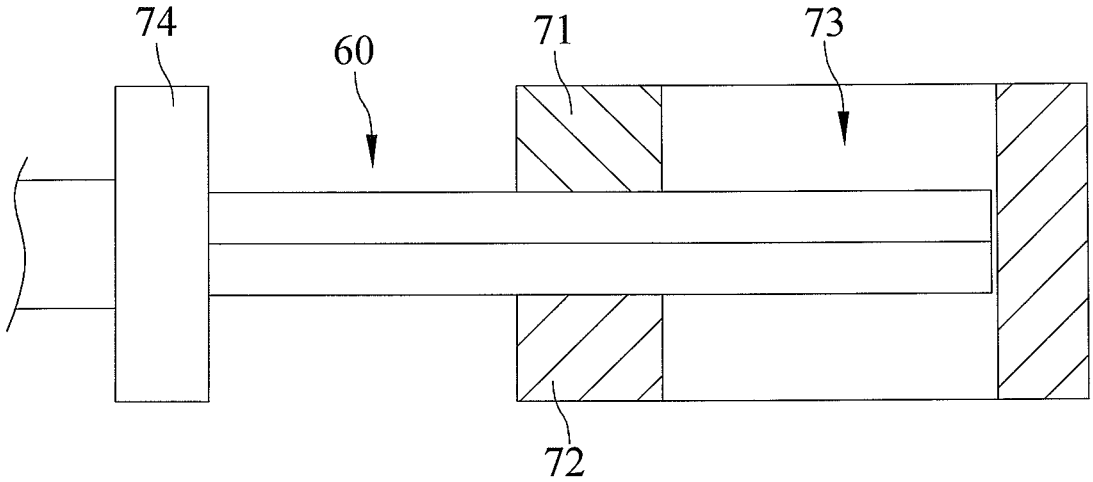
FIG. 17 shows a front view illustrating the second step of the first processing procedure.
Figure 18:
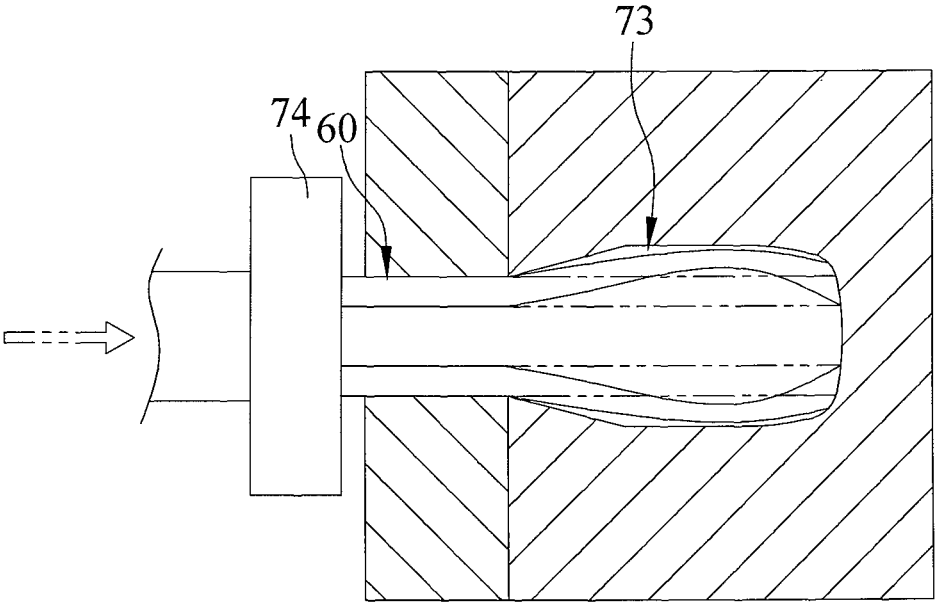
FIG. 18 shows a top view illustrating a third step of the first processing procedure.
Figure 19:
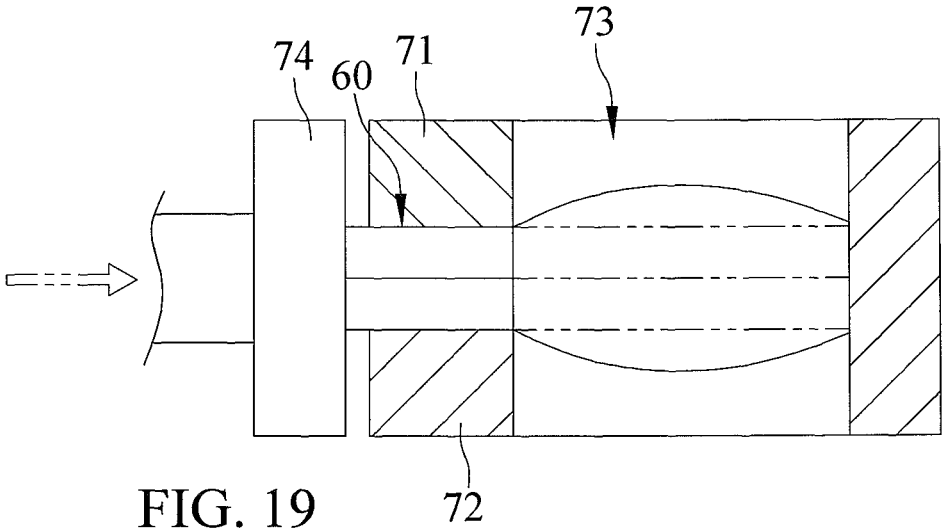
FIG. 19 shows a front view illustrating the third step of the first processing procedure.
Figure 20:
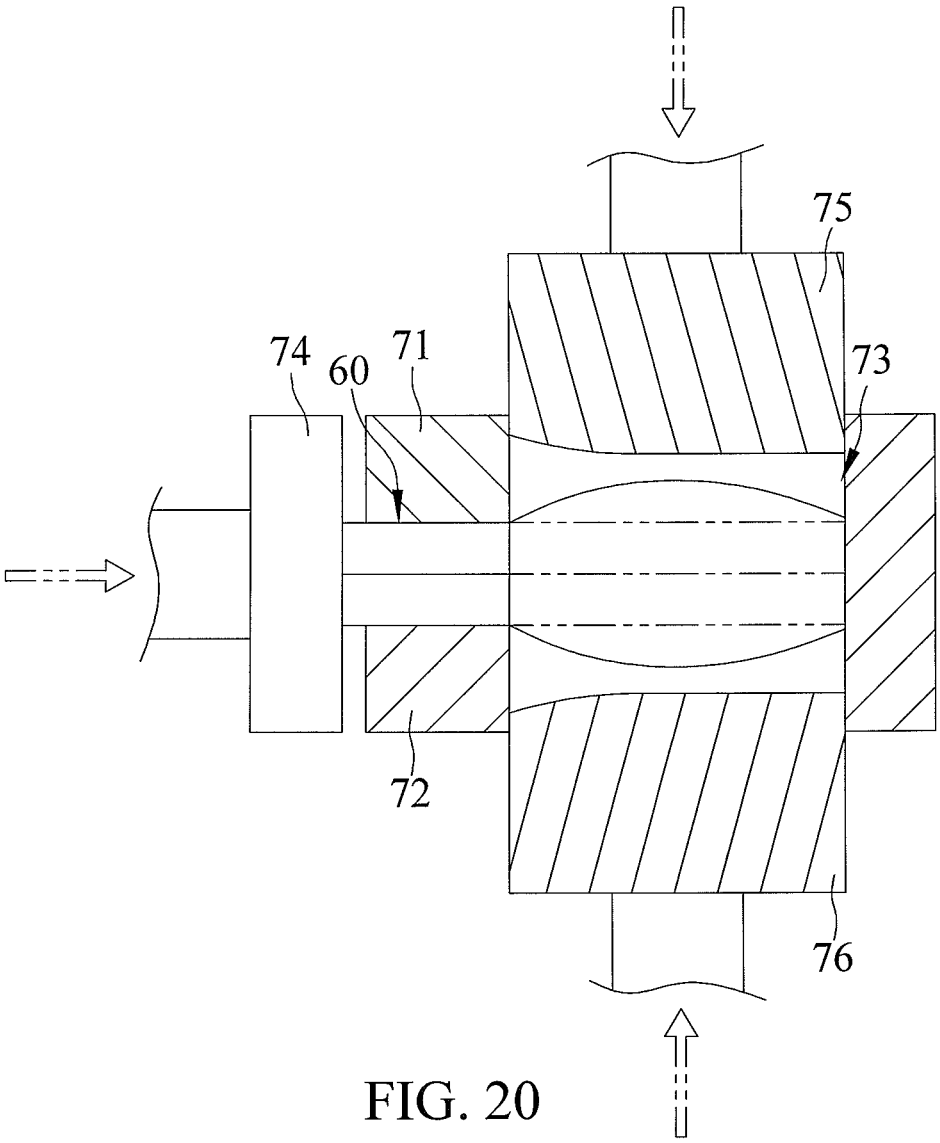
FIG. 20 shows a front view illustrating a first step of a second processing procedure for producing the driving member.
Figure 21:
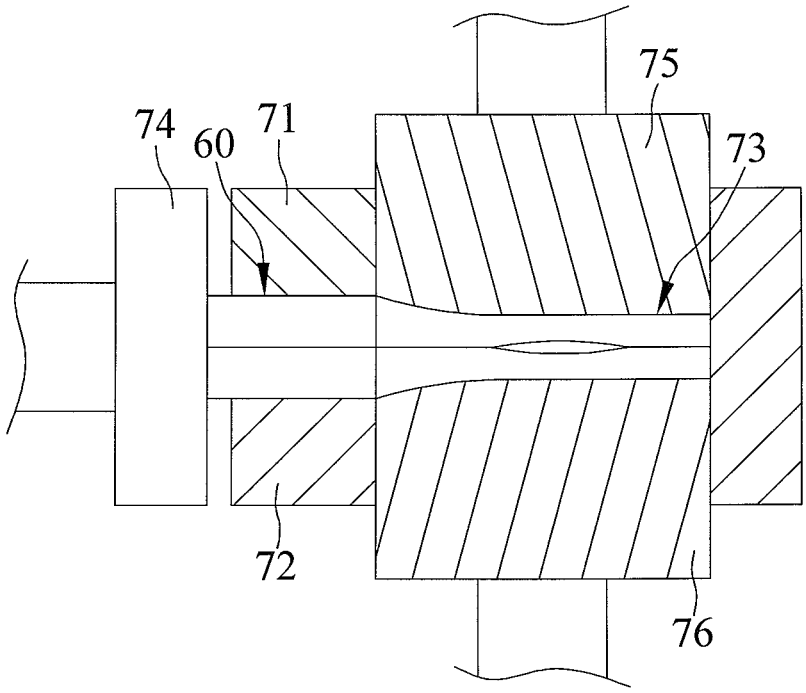
FIG. 21 shows a front view illustrating a second step of the processing second procedure.
Figure 22:
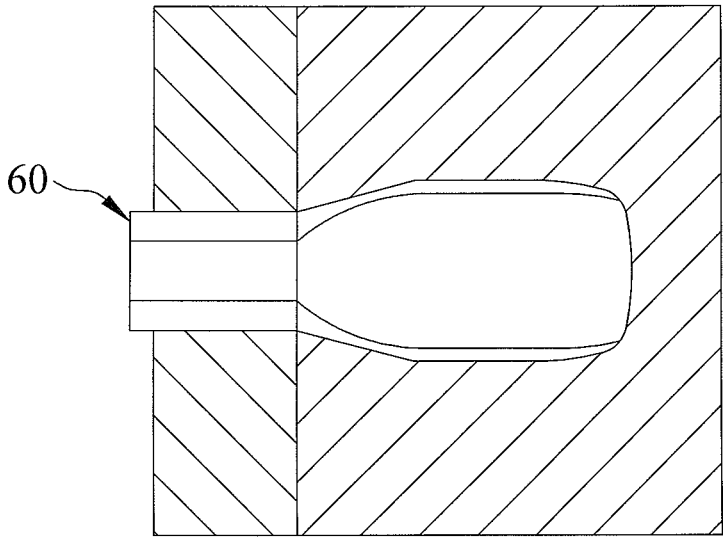
FIG. 22 shows a top view illustrating the second step of the second processing procedure.
Figure 23:
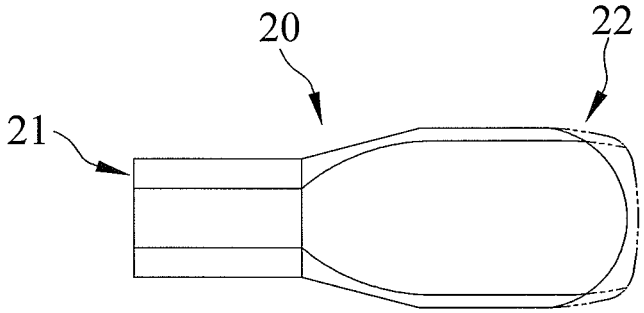
FIG. 23 shows a top view of a final product of the driving member.

With reference to FIGS. 12 and 13, the driving member 20 can pivot relative to the actuating member 30 through at least 180 degrees. In a case that the actuating member 30 is perpendicular to the driving member 20, the hexagonal wrench 10 can obtain the largest arm of force, allowing easy operation by the user. In operation in a limited space, the driving member 20 can be in a desired angular position relative to the actuating member 30 to avoid obstacles during operation.

FIGS. 14-19 show a first processing procedure of the driving member 20. Specifically, a blank 60 for the driving member 20 is an elongated rod having hexagonal cross sections. The blank 60 is formed by drawing. The blank 60 includes first, second, third, fourth, fifth, and sixth faces 611, 612, 613, 614, 615, and 616, with the first face 611 opposite to the second face 612, with the third face 613 opposite to the fourth face 614, with the fifth face 615 opposite to the sixth face 616, with the first, second, third, fourth, fifth, and sixth faces 611, 612, 613, 614, 615, and 616 together defining a regular hexagon.

An upper clamping block 71 and a lower clamping block 72 are used to clamp the blank 60. The upper clamping block 71 includes an upper notch 711 in a bottom side thereof. The lower clamping block 72 includes a lower notch 721 in a top side thereof. The lower notch 721 is aligned with the upper notch 711. The blank 60 is slideable in the upper and lower notches 711 and 721. The upper and lower clamping blocks 71 and 72 clamp an intermediate portion of the blank 60, with an end of the blank 60 extended into a cavity 73. The cavity 73 includes substantially elliptic cross sections perpendicular to the blank 60. A pressing rod 74 is used to press the other end of the blank 60, moving the blank 60 into the cavity 73 until the blank 60 abuts a wall of the cavity 73 and deforms, shortening the length of the blank 60.

FIGS. 20-23 show a second processing procedure of the driving member 20. Specifically, an upper pressing hammer 75 and a lower pressing hammer 76 are moved into the cavity 73 and respectively squeeze two sides of the blank 60 to flatten the blank 60, obtaining the driving member 20. The end of the blank 60 in the cavity 73 becomes the pivotal section 22 of the driving member 20. The other end of the blank 60 becomes the driving section 21 of the driving member 20.

After processing, an end of the first face 611 of the blank 60 in the cavity 73 forms the first pivotal face 221 of the pivotal section 22, an end of the second face 612 of the blank 60 in the cavity 73 forms the second pivotal face 222 of the pivotal section 22, an end of the third face 613 of the blank 60 in the cavity 73 forms the first surface 223 of the pivotal section 22, an end of the fourth face 614 of the blank 60 in the cavity 73 forms the second surface 224 of the pivotal section 22, an end of the fifth face 615 of the blank 60 in the cavity 73 forms the third surface 225 of the pivotal section 22, and an end of the sixth face 616 of the blank 60 in the cavity 73 forms the fourth surface 226 of the pivotal section 22. The other ends of first, second, third, fourth, fifth, and sixth faces 611, 612, 613, 614, 615, and 616 of the blank 60 respectively form the first, second, third, fourth, fifth, and sixth faces 211, 212, 213, 214, 215, and 216 of the driving section 21.

By pressing an end of the blank 60 to shorten the blank 60 and then squeezing the blank 60 to form the pivotal section 22 of the driving member 20, the torque capacity of the driving member 20 can be increased. Compared to other processing methods (including milling, pressing, punching, or forging) for flattening the end of the blank 60 for the purposes of pivotal connection with another member at the cost of reduced cross sectional area and reduced structural strength, the overall structural strength of the driving member 20 of the present invention is increased by increasing the cross sectional area of the pivotal section 22 to be larger than that of the driving section 21 during processing.

The driving member 20 can be processed by cold processing. The structural strength of the driving member 20 can be increased through cold pressing with simple steps. Only a mold and two steps are required to quickly obtain the product, significantly reducing the processing costs of the driving member 20. The blank 60 of the driving member 20 can be easily obtained without preparation of a blank with a specific shape and size reducing the costs for preparation of blanks.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. A hexagonal wrench comprising:

a driving member including a driving section and a pivotal section, with the driving member including a central axis extending through the driving section and the pivotal section, with the driving section including first, second, third, fourth, fifth, and sixth faces, with the first face opposite to the second face, with the third face opposite to the fourth face, with the fifth face opposite to the sixth face, with the first, second, third, fourth, fifth, and sixth faces together defining a regular hexagon, with the pivotal section including a first pivotal face and a second pivotal face opposite to the first pivotal face, with the first pivotal face extending from the first face, with the second pivotal face extending from the second face, with the driving section having a first length between the first and second faces and perpendicular to the central axis, with the pivotal section having a second length between the first and second pivotal faces and perpendicular to the central axis, with the second length smaller than the first length, with the first and second faces having a same first width perpendicular to the first length and the central axis and spaced from the central axis, with the first and second pivotal faces having a same second width perpendicular to the second length and the central axis and spaced from the central axis, with the second width larger than the first width, with the driving section including a first area perpendicular to the central axis, with the pivotal section including a second area perpendicular to the central axis, with the second area larger than the first area, with a connection section extending between the driving section and the pivotal section, with the connection section including a first connection face having a first end connected to the first face and a second end connected to the first pivotal face, with the connection section further including a second connection face having a first end connected to the second face and a second end connected to the second pivotal face, with a thickness between the first ends of the first and second connection faces equal to the first length, with a thickness between the second ends of the first and second connection faces equal to the second length, with the connection section having decreasing thicknesses towards the pivotal section, with the first end of each of the first and second connection faces having a width perpendicular to the thickness and equal to the first width, with the second end of each of the first and second connection faces having a width perpendicular to the thickness and equal to the second width, with each of the first and second connection faces having increasing widths towards the pivotal section;

an actuating member including a pivotal end and an operative end opposite to the pivotal end, with the pivotal end pivotably connected to the pivotal section of the driving member, allowing pivotal movement of the driving member relative to the actuating member, with the operative end adapted to be held and operated by a user; and an operative rod coupled to the operative end of the actuating member, with the operative rod operable to drive the hexagonal wrench, with the operative end of the actuating member including a receptacle, with the operative rod having an end coupled in the receptacle, with the receptacle including circular cross sections and including an inner periphery having a toothed portion, with the end of the operative rod having hexagonal cross sections and detachably engaged with the toothed portion, preventing the operative rod from rotating relative to the actuating member.

2. The hexagonal wrench as claimed in claim 1, with the pivotal end of the actuating member including first and second lugs, with the first lug including a first abutment face facing the second lug, with the second lug including a second abutment face facing the first lug, with a compartment formed between the first and second abutment faces, with the pivotal section of the driving member pivotably received in the compartment of the actuating member, with the first pivotal face abutting the first abutment face of the first lug, with the second pivotal face abutting the second abutment face of the second lug.

3. The hexagonal wrench as claimed in claim 1, wherein the driving member is formed by squeezing a blank, with the pivotal section of the driving member further including first, second, third, fourth and two flat surfaces, with the first surface opposite to the second surface, with the third surface opposite to the fourth surface, with the first surface extending from the third face, with the second surface extending from the fourth face, with the third surface extending from the fifth face, with the fourth surface extending from the sixth face, with one of the two flat surfaces formed between the first and third surfaces, with another of the two flat surfaces formed between the second and fourth surfaces, with the driving section including a third length between the third and fourth faces, with the pivotal section including a fourth length between the first and second surfaces, with the fourth length larger than the third length, with the driving section further including a fifth length between the fifth and sixth faces, with the pivotal section further including a sixth length between the third and fourth surfaces, with the sixth length larger than the fifth length, with the first pivotal face, the second pivotal face, the first surface, the second surface, the third surface, and the fourth surface together defining the second area.

4. The hexagonal wrench as claimed in claim 3, with the connection section further including third, fourth, fifth, and sixth connection faces, with the first connection face opposite to the second connection face, with the third connection face opposite to the fourth connection face, with the fifth connection face opposite to the sixth connection face, with the third connection face including a first end connected to the third face and a second end connected to the first surface, with the fourth connection face including a first end connected to the fourth face and a second end connected to the second surface, with the fifth connection face including a first end connected to the fifth face and a second end connected to the third surface, with the sixth connection face including a first end connected to the sixth face and a second end connected to the fourth surface, with a spacing between the first ends of the third and fourth connection faces equal to the third length, with a spacing between the second ends of the third and fourth connection faces equal to the fourth length, with the third and fourth connection faces having increasing spacings towards the pivotal section, with a spacing between the first ends of the fifth and sixth connection faces equal to the fifth length, with a spacing between the second ends of the fifth and sixth connection faces equal to the sixth length, with the fifth and sixth connection faces having increasing spacings towards the pivotal section.

5. The hexagonal wrench as claimed in claim 4, with the central axis extending through the connection section, with the first ends of the connection section connected to the driving section having a cross sectional area perpendicular to the central axis, with the cross sectional area of the first ends of the connection section equal to the first area, with the second ends of the connection section connected to the pivotal section having a cross sectional area perpendicular to the central axis, with the cross sectional area of the second ends of the connection section equal to the second area, with the connection section having increasing cross sectional areas towards the pivotal section.

6. The hexagonal wrench as claimed in claim 1, with each of the first and second connection faces being a concave face.

7. The hexagonal wrench as claimed in claim 1, with the first pivotal face parallel to the second pivotal face.

8. The hexagonal wrench as claimed in claim 1, with the pivotal section of the driving member including a pivotal hole extending from the first pivotal face through the second pivotal face, with the pivotal end of the actuating member including a pivotal hole extending through the first and second lugs, with the pivotal hole of the driving member aligned with the pivotal hole of the actuating member, with a pin extending through the pivotal holes of the driving member and the actuating member.

9. The hexagonal wrench as claimed in claim 1, with the pivotal section of the driving member including an end face, with the end face being arcuate and convex, with the end face not contacting with the actuating member when the driving member pivots relative to the actuating member.

* * * * *